United States Patent [19]

Fischbach et al.

[11] 4,456,438

[45] Jun. 26, 1984

[54] EXTRUSION DEVICE FOR IMPREGNATING A ROCK FORMATION, PREFERABLY FOR BONDING WITH A LIQUID SYNTHETIC PRODUCT

[76] Inventors: Manfred Fischbach, Glückaufstr. 3c, D-4320 Hattingen; Rolf Hebben, Hohe Egge Höhenweg 12, D-4322 Sprockhövel, both of Fed. Rep. of Germany

[21] Appl. No.: 373,065

[22] Filed: Apr. 29, 1982

[30] Foreign Application Priority Data

Apr. 29, 1981 [DE] Fed. Rep. of Germany ..... 3117027

[51] Int. Cl.[3] ..... F04B 19/02

[52] U.S. Cl. ..... 417/403; 417/469; 91/306; 91/307

[58] Field of Search ..... 417/397, 403, 404, 469; 91/306, 307

[56] References Cited

U.S. PATENT DOCUMENTS

| | | | |
|---|---|---|---|
| 1,835,834 | 12/1931 | Wolfe | 417/404 X |
| 2,667,841 | 2/1954 | Meader | 417/900 |
| 3,846,049 | 11/1974 | Douglas | 417/404 |
| 4,123,204 | 10/1978 | Scholle | 417/397 |
| 4,173,435 | 11/1979 | Hammelmann | 417/469 |

FOREIGN PATENT DOCUMENTS

| | | | |
|---|---|---|---|
| 1923741 | 1/1970 | Fed. Rep. of Germany | 91/306 |

*Primary Examiner*—Leonard E. Smith

*Attorney, Agent, or Firm*—Remy J. VanOphem

[57] ABSTRACT

The invention concerns an extrusion device for impregnating rock formations preferably for bonding with a liquid synthetic product, with the use of a piston pump having at least one working cylinder. During the induction or suction stroke a working piston is filled with the extrusion liquid or with one of its components, and is emptied during the delivery stroke cycle. The working piston is controlled by a pump drive equipped with at least one driving cylinder and a driving piston which can be pressurized on both sides of the piston sequentially. A control valve pressurizes the piston surface with a working fluid as the other working surface of the piston is relieved. The extrusion device, can operate with more efficient utilization of the energy source applied and in particular with extremely high operating pressure of the available hydraulic medium, which is already available but used for other purposes, i.e., the operation of the rams or the hydraulic face- and/or roadway supports.

3 Claims, 10 Drawing Figures

EXTRUSION DEVICE FOR IMPREGNATING A ROCK FORMATION, PREFERABLY FOR BONDING WITH A LIQUID SYNTHETIC PRODUCT

BACKGROUND OF THE INVENTION

The invention concerns an extrusion device for impregnating a rock formation, preferably for bonding with a liquid synthetic product, with the use of a piston pump having at least one working cylinder.

The invention is applicable, in particular, to underground excavation operations and to the impregnation of the rock or the mineral, respectively, in particular, overhanging coal. Preferably, the invention is used for stabilizing the formation by bonding teary strata with the aid of a diisocyanate and polyalcohol by using polyurethane foam compound consisting of these two components. Although the invention can, be applied for saturating the face of the coal with water, it is explained in detal in the following description of its application to the extrusion of the so-called standard compound for mining of the two component foam compounds mentioned above.

For this application of the invention a working cylinder must be provided for each of the two components, because the two liquid components may only be combined in a bore hole. For this type of piston pump a working cylinder may be provided. Occasionally it is practicable to align a driving cylinder with each working cylinder so as to apply the propulsive force more advantageously to the driving piston. On the one hand, the control of the driving cylinder must insure that the driving pistons are operated with the force required to operate the working piston. On the other hand, the control must insure a timely reversal at the end of each cycle and that the energy contained in the working fluid is converted most effectively into pump energy.

According to the prior published state of the art (magazine Gluckauf 113 (1977), 707, 711,) a gear pump is driven by a pneumatic motor. It has the disadvantage that compressed air is not always available in the needed amount and at favorable energy cost and, further, the gear pump must be able to handle component extrusion fluids of different viscosities, as is the rule with the above mentioned standard compound for mining. Differences in viscosity between the two extrusion fluids makes adherence to the specified ratio of the liquid components practically impossible, primarily because of the unavoidable loss by leakage, thereby resulting in reduced efficiency.

SUMMARY OF THE INVENTION

These disadvantages are overcome by the invention described herein. A device has already been suggested, which, instead of a geared pump, provides for each component a working cylinder and for each working cylinder a hydraulically operated driving cylinder. Piston pumps avoid the clearance losses experienced with geared pumps, because piston pumps operate with sealed pistons. It is relatively easy to control them so that the unintended blending of the two components in a working space is prevented. Further, the required high operating pressure can be applied without significant energy losses. As a rule, the hydraulic drive is superior to the pneumatic drive as the extrusion system can be operated with any type of energy source, and for this reason neither the availability of a specific type of energy nor its power limitation is a deterring factor.

The invention has its primary objective to design the extrusion device which overcomes the shortcomings of the previously published state of the art so that it can be operated with a high degree of utilization of the energy source applied, and in particular, that it can be operated with extremely high operating forces of the hydraulic medium which is conveniently available onsite for other purposes, e.g., for operating the rams or for the hydraulic roadway and/or face-supports.

This problem is solved according to the invention by the distinguishing characteristics of the patent claims.

By providing a control spindle for regulating the working valves which control the in-flow and outflow from the pressure chambers of the working cylinder, any number of valves can be operated in precisely timed synchronization, which is a prerequisite for the application of high pressures of the operating medium. Operating the control spindle with the operating fluid has the added advantage of being able to reverse the control spindle instantly because of the high propulsive force. This is accomplished when the appropriate signal is triggered at the end of the path of the piston travel in the driving cylinder. By using the driving piston for opening the valves controlling the pressure chambers of the driving cylinders, the reversal of the driving piston can be carried out automatically, i.e. in the respective end position of the driving piston, while at the same time avoiding, through the reversing lag of the valves effecting the pressure chambers of the control spindle, that these are closed too suddenly due to the high pressure of the hydraulic fluid.

The invention therefore has the advantage that the driving cylinders can be operated via a valve control which, as opposed to a slide-valve gear, prevents fluid loss and is therefore particularly well suited for high hydraulic fluid pressure applications. These pressures may be in the range of 150 bar, as are used underground for operating the step and ram cylinders; also driving forces of up to 300 bar can be considered, as are associated with the hydraulic mine props, such as for shaft shields. These are in particular, pressure water or pressure emulsions which are used underground because of their incombustible nature, but which also have lubricating characteristics.

Preferably the cylinder chambers are continuously loaded with the hydraulic fluid via a throttle, and the discharge is directed via one of the control valves, the outflow of which is chosen to be greater than the inflow via the throttle. This then means that the pressure chamber, the control valve of which is closed, governs the actuation of the control spindle, but excessive mechanical stresses cannot arise.

The control is preferably constructed as a spindle, the ends of which move into the control pressure chambers as pistons. Between the ends of the spindle is a plurality of ramps, cylindrical portions or sections whereupon the driving valve rollers travel thereby controlling the two pressure chambers of the driving cylinder.

The invention is applicable in particular in combination with valve controlled working cylinders. This type of working cylinder accommodates the considerable extrusion pressures and avoids the disadvantages of a slide-valve gear under high pressure. According to the invention, the working cylinder is equipped with a hollow piston for the suction or intake stroke and for the delivery or ejection stroke with a concentric piston rod located within the hollow cylinder. It is possible to operate intake and delivery via only one opening in the working cylinder, in which case only the final delivery opening has to be provided with a check valve.

BRIEF DESCRIPTION OF THE DRAWINGS

The details, additional characteristics and other advantages of the invention can be seen in the following description of an embodiment with the aid of the figures in the drawing which show.

DETAILED DESCRIPTION OF THE PREFERRED EMBODIMENT

Figures 1, 2:
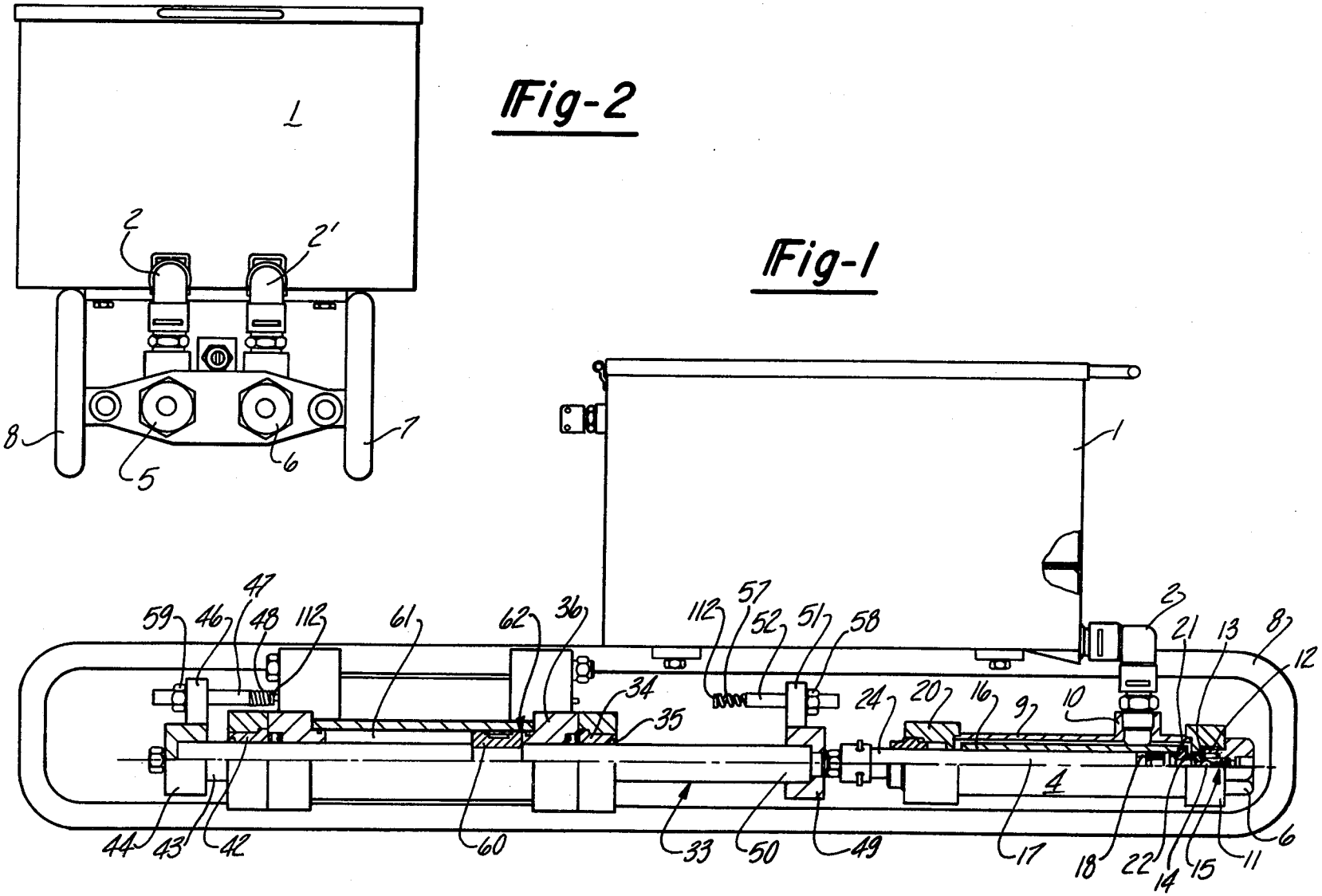
FIG. 1 is a side view, in partial section, of a two cylinder piston pump according to the invention.
FIG. 2 is a front view of the embodiment shown in FIG. 1.
Figure 3:
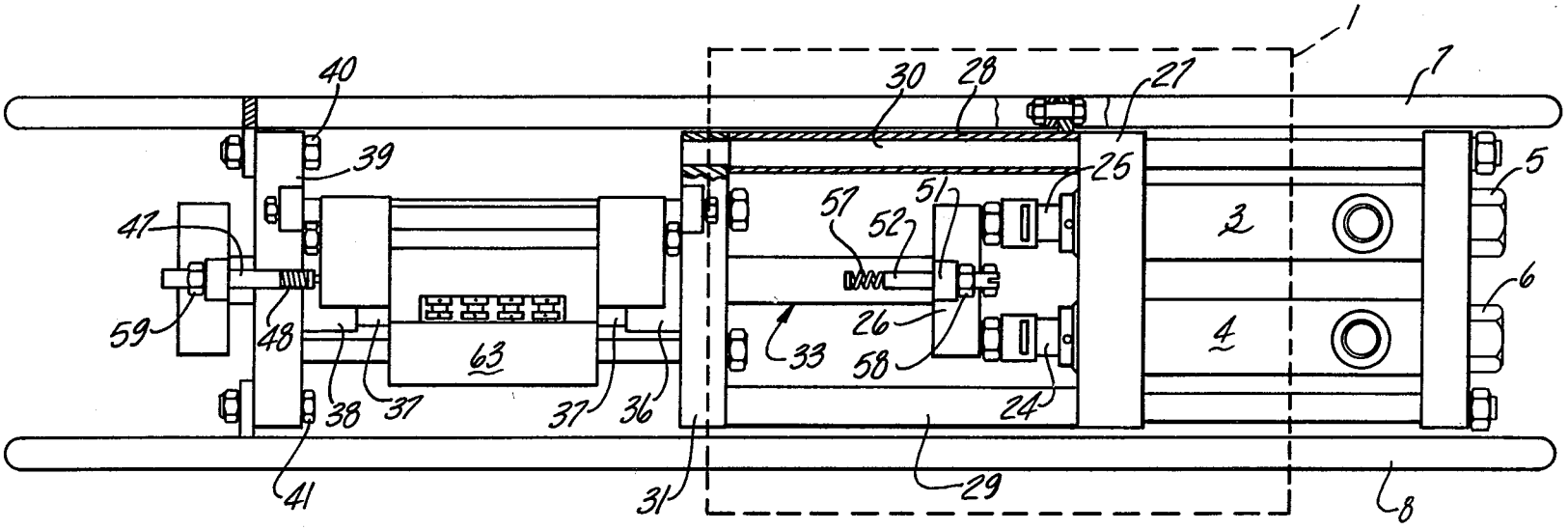
FIG. 3 is a plan view of the two cylinder pump of FIG. 1 with the tank shown in phantom line to more clearly display the components located underneath the tank.

FIGS. 1 through 3 show the basic construction of the extrusion device according to the invention. The extrusion compound consists of two components, which flow from the tank 1 via either the elbow 2 or 2' into one of the two working cylinders 3 or 4, respectively. The delivery lines to the cylinders 3, 4 are provided with a hydraulic connection at 5 and 6. The two working cylinders 3, 4 are operated in the same cycle, so that the different components from the tank 1 and the working cylinders 3, 4 are drawn in simultaneously and discharged simultaneously with the next cycle by the working cylinders at the hydraulic connections 5, 6. Not shown is the subsequent delivery line, where the components are finally combined.

Instead of a two component compound, the embodiment described consisting of the working cylinders 3, 4 may also be utilized to pressurize water or similar liquids.

A tubular frame consists of two side rails 7, 8 which protect the operating parts and its driving member. The side rails are generally rectangular and are installed parallel to each other. They support the tank 1 for the extrusion liquid, which is connected to the working spaces of the cylinders via the plug-in disconnect mountings at the elbows 2 and 2'.

The working cylinders 3, 4 and the parts associated with each cylinder are constructed identically. A cylinder barrel 9 has at its delivery line end a vacuum connection or inlet 10 and is closed with a bushing 11, which is screwed into the face of the housing 12 of a one way check valve. The one-way check valve is equipped with a ball valve 14 and a spring 15. The seat of the ball is shown in FIG. 1 at 13. The check valve is installed so that it automatically closes the delivery line 5, 6 when the respective pump cylinder inducts the cylinder contents via the vacuum line connection 10.

The suction cycle is executed with a hollow piston 16, which is coaxially mounted on a piston rod 17, which on its part is sealed at 18 against the inside of the hollow piston 16.

For the suction stroke, both the hollow piston 16 the piston rod 17 are moved to the left as viewed in the drawing in FIG. 1, whereupon the check valve closes and the fluid compound enters the cylinder via the elbow 2 through the inlet 10 into the cylinder barrel 9. During this process both the hollow piston 16 and the piston rod 17 lift off the bushing 11 until the hollow piston 16 abuts a bushing 20 located at the opposite end of the piston cylinder. This clears the way for the fluid compound to be introduced into the hollow piston 16 along its end face. During the further movement of the piston rod 17 the hollow piston 16 remains stationary and the fluid compound is drawn in via the inlet 10 until the piston rod 17 has reached the end position of its suction stroke. After reversing, the piston rod 17 begins the compression stroke and moves to the right as viewed in the drawing in FIG. 1. The hollow piston 16 travels along with the piston rod until the hollow piston end face seals with its front end 21 on its associated seat 22 of the check valve. Therefore the drawn-in fluid compound cannot flow back via the inlet or vacuum connection 10. The ball of the check valve 14 is pushed by the continued movement of the piston rod 17 against the force of the spring 15, whereby the drawn-in fluid compound is pushed into the subsequent delivery line (not shown) via the respective hydraulic connection 5, 6.

As the pump operates without a suction valve, even compounds of high viscosity can be handled without suction problems.

As shown in FIG. 3, the piston rod ends 24, 25 extending beyond the bushings 20 are attached to a common yoke 26. The cylinders are mounted on a crossbar 27 of the tubular frame. The crossbar 27 further supports two fixed pipes 28, 29 mounted in each of which is a rod 30 with a similar fixed yoke 31 as the fixed yoke 26. The yoke 31 supports a bushing 34 with a wiper 35, as best illustrated in FIG. 1, for a piston rod 33 of a drive unit. The piston rod 33 is connected to the yoke 26 so that it extends equidistant from the central axis of the piston rods 17 of each of the two working cylinders 3, 4.

Also attached to the yoke 31 is a bushing 36 which encloses one end of the driving cylinder 37, the other end of which is likewise enclosed with a bushing 38. This bushing 38 is attached to a crossyoke 39, which holds the two side rails 7, 8 of the tubular frame together with a screw-coupling 40, 41. The bushing 38 has a wiper design 42 for the other end 43 of the piston rod 33. Mounted on this other end 43 of the piston rod is a shelf 44, on which a pad 46 is mounted, which in turn supports a tappet 47 with a tappet spring 48 mounted parallel to the piston rod. A similar shelf 49 is mounted at the one end 50 of the piston rod 33, with a pad 51, supporting a tappet 52, which is also equipped with a spring 57. Both of the tappets 47 and 52 are adjustable via the adjustment screws 58, 59.

Mounted on the piston rod 33 is the driving piston 60 which divides the driving cylinder 37 into two independent pressure chambers 61, 62. The driving piston 60 has end faces of equal size for both pressure chambers 61 and 62. A control valve 63 for the driving cylinder 37 is located between the two side rails 7, 8 or the tubular frame, directly mounted to the driving cylinder 37.

For the alternating pressurizing of the pressure chambers 61, 62 of the driving cylinder 37 an automatic control valve is provided which is explained in detail with reference to FIGS. 4 through 7 as follows.

The two pressure chambers 61, 62 are connected via lines or connections A and B to the inlet and outlet of the pressure medium. They are placed under pressure or relieved of pressure through the driving valves 91, 93 or 92, 94 respectively. The driving valves are controlled by a spindle S, the ends of which form pistons 70, 71 housed in cylinders 72, 73, forming pressure chambers 74, 75. The spindle has cylindrical portions 76, 77 of identical diameter and a center section 78, as well as end sections each 79, 80 of larger diameter, whereby the outer diameter of the center and end sections 78, 79 and 80 are identical. Conical parts 81, 82, 83, 84 connect the cylindrical portions of different diameters and serve as ramps for the mechanical components 85, 86, 87, 88 of the two-way valves 91, 92, 93, 94. The control valve 63 operates according to the following description.

Figure 4:
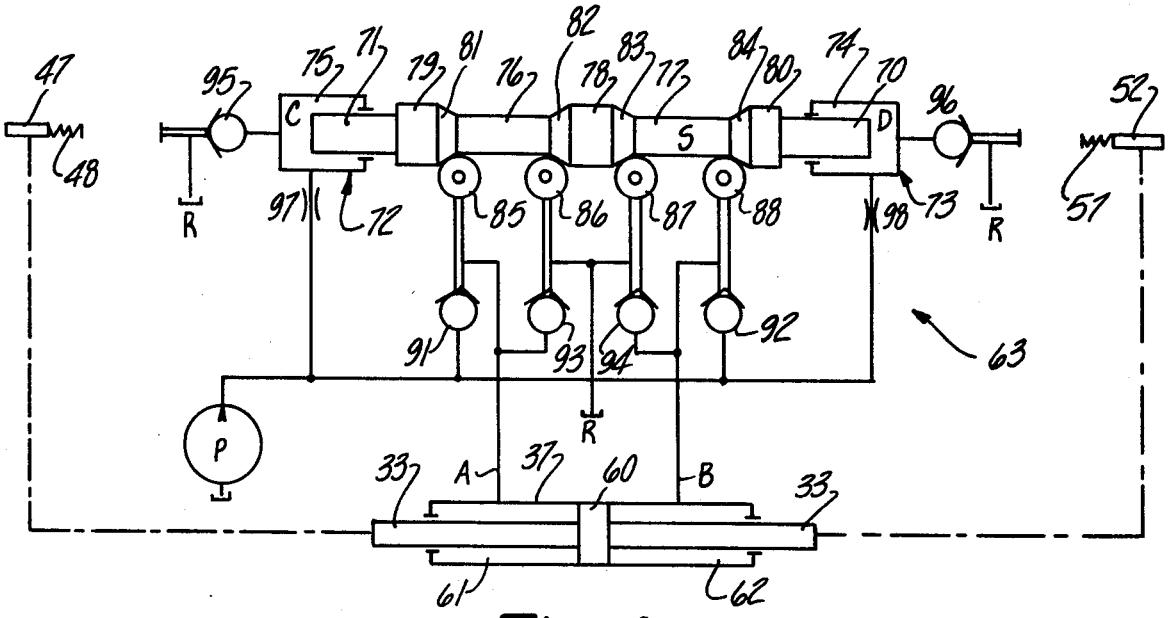
FIG. 4 shows the control valve arrangement for the driving cylinder with the driving piston at rest at the center of its travel.

In the position in FIG. 4 all of the valves 91, 92, 93, 94, 95, 96 are closed. The flow of the pump P and the cylinder connections A and B are blocked. The spindle S is in its center position, and the driving piston 60 does not move in the driving cylinder 37.

Figure 5:
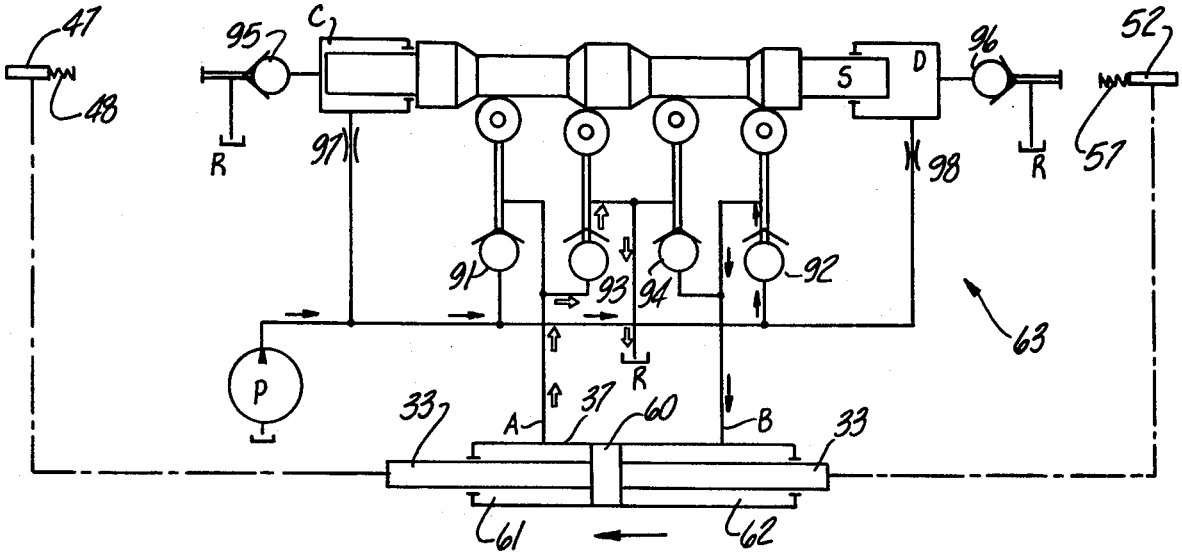
FIG. 5 shows the control valve arrangement according to FIG. 4 with the driving piston moving in the direction indicated by the arrow.
Figure 6:
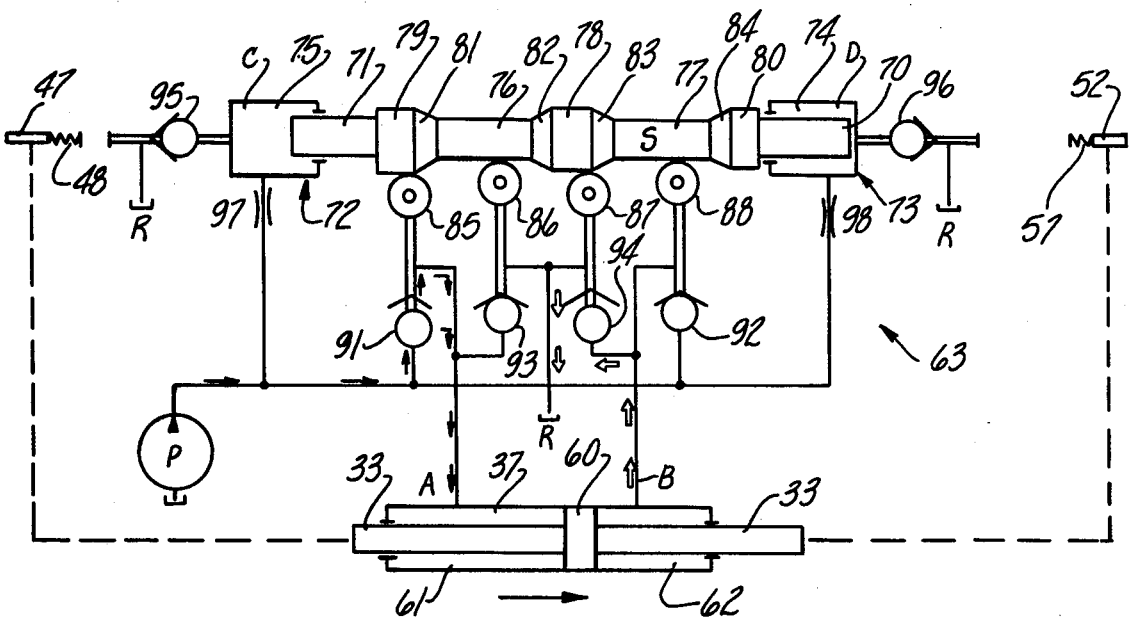
FIG. 6 shows the position of the control valve arrangement according to FIGS. 4 and 5 with the driving piston moving in the opposite direction from that of FIG. 5.

To start the pump, the pump inlet must first be closed to relieve the pressure on the inlet side of the pump. The spindle S is then manually moved into either of its end positions, as shown in FIGS. 5 and 6, respectively. Thereafter the pump can start up. As soon as the pump flow is released, the pump begins to operate.

In the configuration of FIG. 5 the pressure chambers C and D of the spindle S are both supplied with the driving pressure from the pump. Therefore the position of the spindle S is fixed, as long as the valves 95, 96 are closed. The driving piston 60 and the piston 33 move to the left in the illustration in FIG. 5, which corresponds to the suction stroke of the piston rod 17. The movement occurs because the driving valves 92 and 93 have been opened due to the mechanical components 86 and 88 moving up their respective ramps and becoming influenced by the center section 78 and the end section 80, respectively. Therefore hydraulic fluid enters the driving cylinder 37 under the influence of the two-way valve 92 via connection B, and the driving piston 60 displaces fluid via connection A due to the two valve 93 into the return line.

The configuration of FIG. 6 shows the reverse position from that of FIG. 5, wherein the driving piston 60 and the piston 33 move in the opposite direction, corresponding to the ejection or delivery stroke of the piston rod 17.

Figure 7:
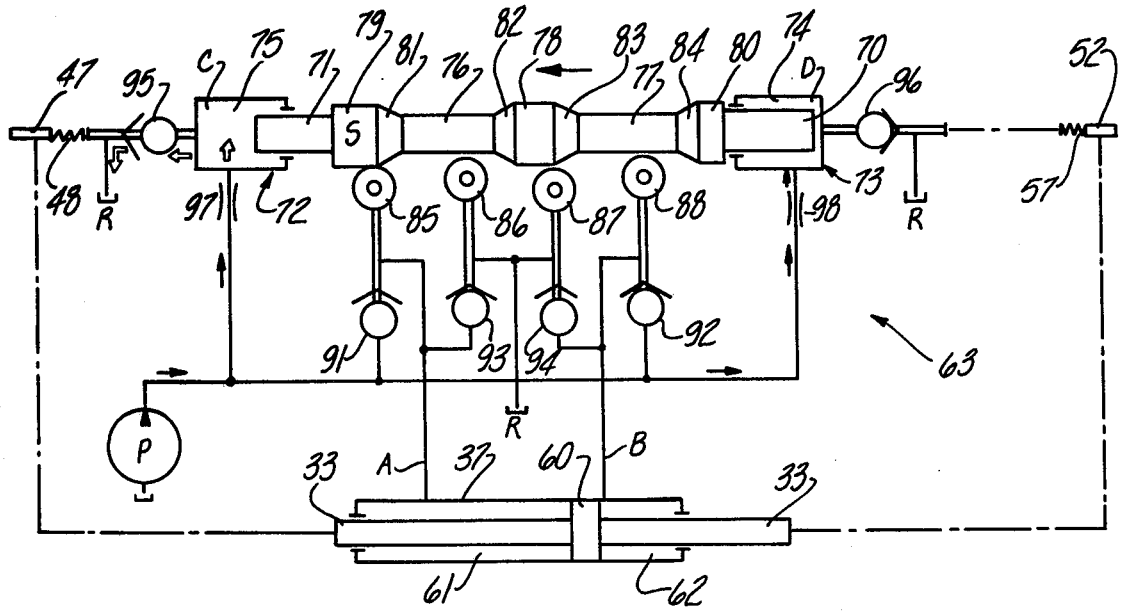
FIG. 7 shows the control valve arrangement according to FIGS. 4 to 6 during reversal of the driving piston.

FIG. 7 illustrates the position of the driving cylinder as it begins the suction stroke. The piston rod 33 has reached its mechanical end position, that is, the end of its delivery or injection stroke at this position, and the control valve 95 is opened by the tappet 47 via the tappet spring 48. Therefore the pressure in the chamber C is relieved, in that, more fluid escapes via the control valve 95 as can enter via a throttle 97. Since the control valve 96 remains closed, the spindle S is pressed towards the opposite end position by the inflow of hydraulic fluid in the chamber D via a throttle 98. Moving the spindle towards the chamber C closes the operating valves 91 and 94, while the operating valves 92 and 93 open, causing the piston rod 33 to move into the opposite direction.

Therefore, in each of the respective end positions of the piston rod 33 the opening of the control valves 95 and 96 causes automatic reversal. The driving cylinder operates otherwise via control by the valves.

The control valves 95 and 96 open as the springs 48 or 57, respectively, are compressed, the pressure within the valves decreases during the initial path of travel of the tappets 47, 52, which upon reversing cause the valves 95, 96 to close again. As a result, the movements of the spindle are initiated instantly, but are not sudden in spite of the high pressures exerted by the hydraulic fluid.

Figure 8:
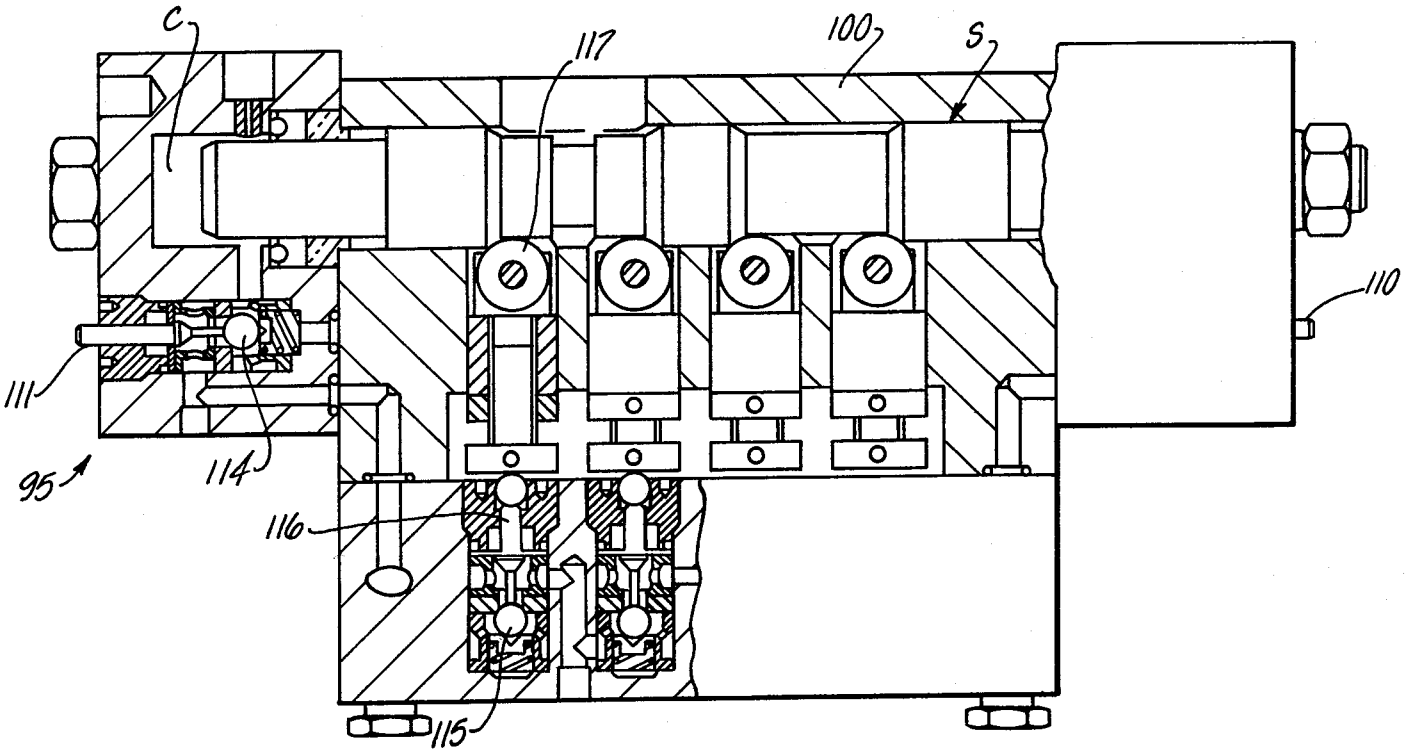
FIG. 8 shows a partial cross-section of a housing including the important components of the hydraulic control.
Figure 10:
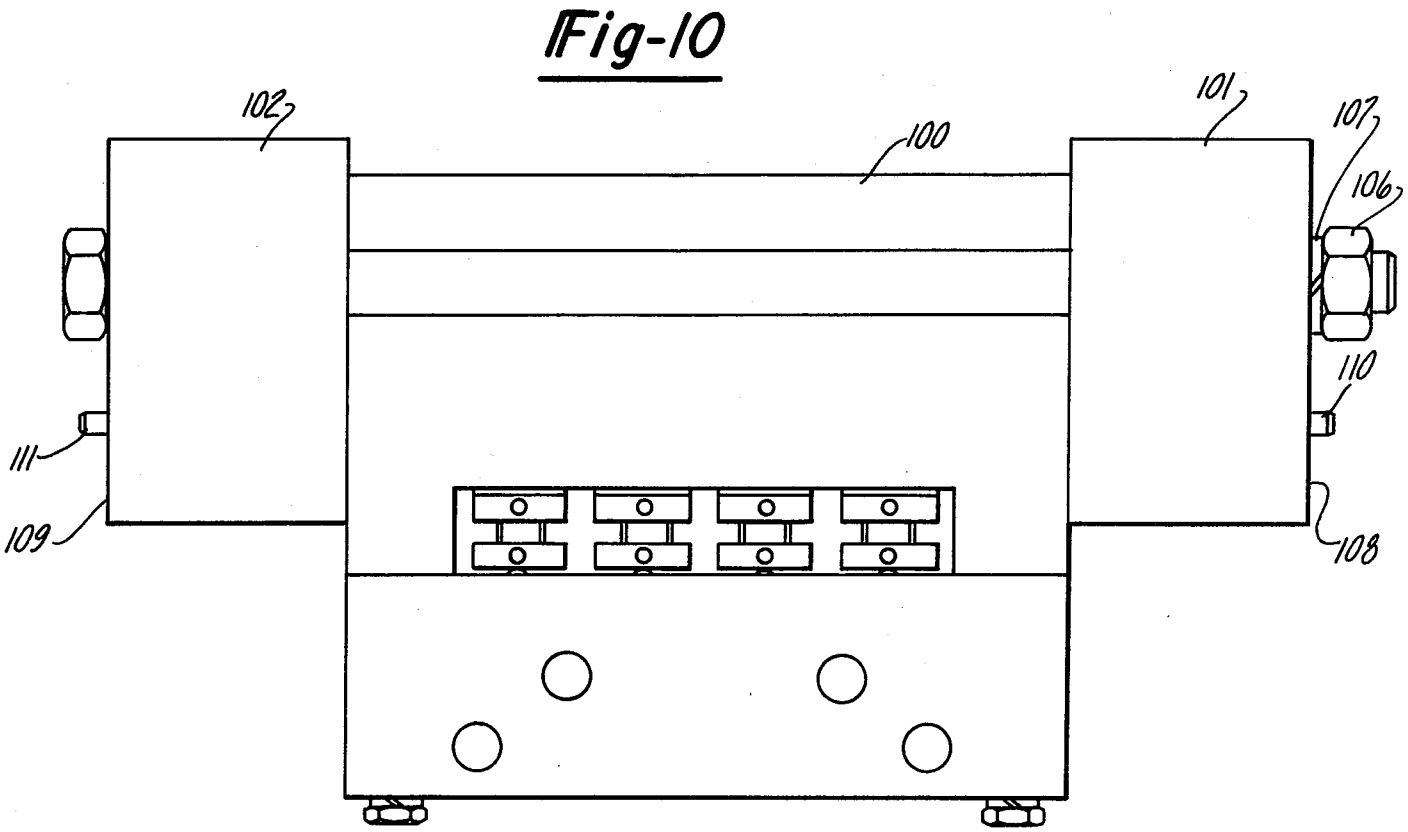
FIG. 10 is a side view of the housing of FIG. 8.
Figure 9:
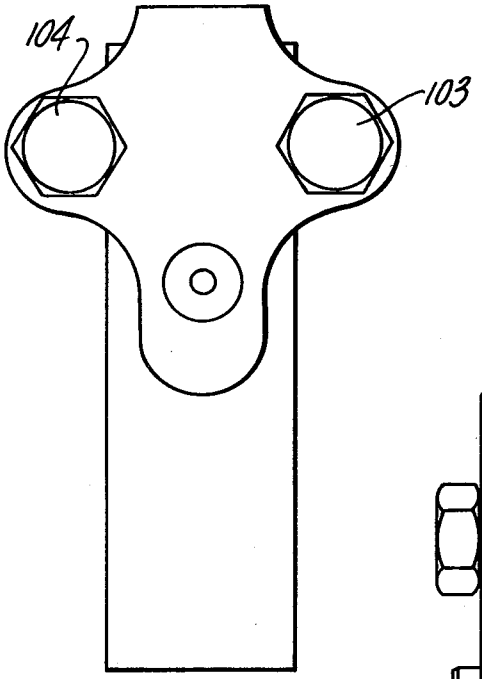
FIG. 9 shows a front view of the housing of FIG. 8.

FIGS. 8 to 10 show an applied embodiment of a control, the action sequency of which has been described with the aid of FIGS. 4 to 7. Accordingly, the spindle S is located in a housing 100, which is closed on both its ends with end caps 101 or 102, respectively. The two caps are connected to one another by head bolts 103 or 104, respectively, acting as tie rods, and are pressed against the face of the housing. Nuts 106, with lock washers 107, are threaded onto the ends of the head bolts 103, 104. On each outer face 108 or 109 of the caps the tappets 110 or 111, respectively, of the control valves 95 or 96, respectively, protrude. These tappets are acctivated by the valve heads 112 (FIG. 1), which are mounted on the springs 48 or 57, of the tappets 47 or 52, respectively.

The control valves 95, 96 are constructed identically and have a valve ball 114 as a closing or throttling member, which is loaded with the force of a spring and can be lifted off its seat by the tappet 111.

The pressure chambers C and D are also contained in the end caps 101 or 102 respectively.

The driving valves 91, 92, 93, 94 are also constructed identical to the illustrated valve 95 and, like the control valves, are each provided with a ball 115 serving as a closing or throttling member. The valve tappet 116 of each driving valve 91, 92, 93, 94 carries on its free end a roller 117, which travels on the spindle.

Having described the invention, I claim:

1. An extrusion apparatus for impregnating rock formations in underground excavations with a liquid synthetic bonding compound, said apparatus comprising:

a base member;

a container mounted to said base member;

working cylinder means mounted to said base member, said working cylinder means having at least one working cylinder member comprising:

a housing member having a bore extending therethrough;

ball check valve means mounted at one end of said bore of said housing member for selectively sealing said one end of said bore;

stop means located about the other end of said bore;

a piston rod member having one end mounted in said bore of said housing member and an opposite end extending from said housing member, said piston rod member adapted to move from a first predetermined position to a second predetermined position;

a hollow piston member interposed between said housing member and said piston rod member, said hollow piston member adapted to move with said piston rod member between a first intake position and a second delivery position when said piston rod member moves between said first and said second predetermined positions, said first intake position defined by an abutment of said hollow piston member and said stop means;

sealing and engaging means interposed between said piston rod member and said hollow piston member for slidingly sealing and engaging said one end of said piston rod member with said hollow piston member to define a housing chamber between ball said check valve means and said one end of said piston rod member; said sealing and engaging means causing said hollow piston member to move with said piston rod member between said first intake position and said second delivery position when said piston rod member moves between said first and said second predetermined positions;

conduit means having one end attached to said container and an opposite end mounted to said housing member, said conduit means further having a passage with one end communicating with the contents of said container and an opposite end communicating with said housing chamber such that the contents of said container may be communicated to said chamber;

driving means for reciprocally moving said piston rod member between said first and second predetermined positions, said driving means being mounted to said base member in an axial spaced relationship with said working cylinder means such that said driving means reciprocates said piston rod member from said first predetermined position whereby said hollow piston member is moved to said first intake position to allow said liquid synthetic bonding compound of said container to be drawn into said housing chamber, said ball check valve means sealing said one end of said bore of said housing when said hollow piston member is moved to said first intake position, said driving means further moving said piston rod member to said second predetermined position whereby said hollow piston member is moved to said second delivery position to deliver said liquid synthetic bondings compound past said ball check valve means and expel said liquid synthetic bonding compound from said bore; and means for mounting said working cylinder means to said base member.

2. The apparatus as claimed in claim 1 wherein said working cylinder means comprises at least two working cylinder members and said driving means further comprising:

yoke means connected to said opposite end of said piston rod member of each of said at least two working cylinder members for simultaneously moving said piston rod members between said first and second predetermined positions;

a driving cylinder member mounted to said base member, said driving cylinder member having one end and an opposite other end;

a driving piston member mounted in said driving cylinder member, said driving piston member defining a first and second chamber in said driving cylinder member, said driving piston member further having a first piston rod portion defining a driving piston working surface, said first piston rod portion further projecting into said first chamber and extending from said one end of said driving cylinder member and further being attached to said yoke means connected to each said piston rod member of said at least two working cylinder members; a second piston rod portion defining another driving piston working surface, said second piston rod portion further projecting into said second chamber and extending from said opposite other end of said driving cylinder member; and actuating means for actuating said driving piston member, said actuating means mounted to said driving cylinder member and said base member for communication with said working cylinder means such that when one of said driving piston working surfaces is loaded at a predetermined rate the other of said driving piston working surfaces is unloaded at a predetermined faster rate, said actuating means further comprising:

a fluid control valve comprising a body having an elongated body bore, a plurality of passages terminating in said bore, and the ends of said bore defining a first and second chamber; an elongated slide spool reciprocably mounted in said bore, said slide spool having opposite end faces, one of said end faces terminating in said first chamber to define a first pressure chamber, the other of said end faces terminating in said second chamber to define a second pressure chamber, said slide spool further having a plurality of reduced diameter portions between said end faces; spaced to cooperate with said plurality of passages in the control valve;

pressurizing means for pressurizing said first and second pressure chambers of said fluid control valve with a fluid pressure medium, said pressurizing means further comprising communicating means for communicating the pressure in said first chamber of said fluid control valve to said first chamber of said driving cylinder member, said communicating means further communicating the pressure in said second chamber of said fluid control valve to said second chamber of said driving cylinder member; and means for reversing the direction of movement of the said driving piston member when said driving piston member reaches an end of travel position at one of said one end and said other end of said driving cylinder member.

3. The apparatus as claimed in claim 2 wherein said means for reversing the direction of movement of the said driving piston member further comprises:

first tappet member mounted to said first piston rod portion extending from said one end of the said driving cylinder member;

a second tappet member mounted to said second piston rod portion extending from said opposite end of the said driving cylinder member;

first means for normally regulating the pressure of said first pressure chamber of said fluid control valve, said first regulating means comprising a first check valve mounted in said body of said fluid control valve and adapted to be opened by said first tappet member and to thereby decrease said pressure in said first pressure chamber;

second means for normally regulating the pressure of said second pressure chamber of said fluid control valve, said second regulating means comprising a second check valve mounted in said body of said fluid control valve and adapted to be opened by said second tappet member and to thereby decrease said pressure in said second pressure chamber; and means for mounting said first and second tappet members to said first and second piston rod portions, in spaced relationship with said fluid control valve, whereby said first and second tappet members open said respective first and second check valves to reverse the direction of movement of said driving piston member when said driving piston member reaches its respective end of travel position in the said driving cylinder member.

* * * * *

UNITED STATES PATENT AND TRADEMARK OFFICE

CERTIFICATE OF CORRECTION

PATENT NO. : 4,456,438

DATED : June 26, 1984

INVENTOR(S) : Fischbach et al.

It is certified that error appears in the above-identified patent and that said Letters Patent is hereby corrected as shown below:

Column 1, line 22, delete "detal" and insert ---- detail ----.

Column 1, line 41, delete "711,)" and insert ---- 711), ----.

Column 4, line 12, after "16" insert ---- and ----.

Column 6, line 31, delete "acctivated" and insert ---- activated ----.

Column 7, line 11, before "ball" insert ---- said ----.

Column 7, line 12, delete "said" first occurrence.

Signed and Sealed this

*Twelfth* Day of *February 1985*

[SEAL]

*Attest:*

DONALD J. QUIGG

*Attesting Officer* *Acting Commissioner of Patents and Trademarks*